US008585448B2

(12) United States Patent
Timsit

(10) Patent No.: US 8,585,448 B2
(45) Date of Patent: Nov. 19, 2013

(54) SPRING-LOADED COMPRESSION ELECTRICAL CONNECTOR

(76) Inventor: Roland S. Timsit, Toronto (CA)

( * ) Notice: Subject to any disclaimer, the term of this patent is extended or adjusted under 35 U.S.C. 154(b) by 174 days.

(21) Appl. No.: 13/010,801

(22) Filed: Jan. 21, 2011

(65) Prior Publication Data

US 2011/0318974 A1 Dec. 29, 2011

(30) Foreign Application Priority Data

Jun. 29, 2010 (CA) ..... 2708699

(51) Int. Cl.
*H01R 4/10* (2006.01)

(52) U.S. Cl.
USPC ..... 439/882; 439/862; 439/877

(58) Field of Classification Search
USPC ..... 439/882, 861, 877
See application file for complete search history.

(56) References Cited

U.S. PATENT DOCUMENTS 3,156,764 A 11/1964 Toedtman
3,897,992 A 8/1975 Weidler
4,291,934 A * 9/1981 Kund ..... 439/421
4,904,213 A * 2/1990 Hock et al. ..... 439/824
5,519,170 A * 5/1996 Nabeshima ..... 174/74 R
8,187,043 B2 * 5/2012 Kumakura et al. ..... 439/882

FOREIGN PATENT DOCUMENTS

GB 2165708 A 4/1986

OTHER PUBLICATIONS

International Search Report & Written Opinion in PCT /CA2011/000742 or Oct. 24, 2011.

* cited by examiner

*Primary Examiner* — Truc Nguyen
(74) *Attorney, Agent, or Firm* — Manelli Selter PLLC; Edward J. Stemberger

(57) ABSTRACT

A connector having a spring inserted internally in a compression or crimp connector, or in a bolted compression connector, in contact with the electrical conductors to be connected electrically wherein the spring is capable of being mechanically deformed during compression of the connector and wherein the spring is capable of maintaining its elastic resilience and elastic springback properties to generate and maintain the required compression force on the conductor. The spring may be a metal mechanical spring or formed of a resiliently flexible material, particularly a polymeric material.

16 Claims, 12 Drawing Sheets

SPRING-LOADED COMPRESSION ELECTRICAL CONNECTOR

FIELD OF THE INVENTION

This invention relates to the use of elastic-energy storage devices in compression connectors of any type to maintain a large contact load in the electrical interfaces and promote long-term reliability.

BACKGROUND OF THE INVENTION

The ultimate aim of an electrical connector is to generate an electrical connection capable of enduring the stresses of the service environment. The expected life of an electrical connector in a consumer electronic device varies with the application but generally ranges from 10 to 20 years; the life expectancy of power connector in overhead and underground power lines is usually 30-40 years. In the latter applications, there are stresses on electrical connections stemming from the local environment that may vary from desert-like to very cold, and from dry to damp marine conditions. For any connector type, there are additional stresses that include rapidly-varying conductor temperatures stemming from variations and fluctuations in current loadings, fretting and galvanic corrosion within the connector, mechanical vibrations etc. These stresses are described in detail elsewhere [1-3] and are responsible for electrical degradation of the connections because they generally lead to loss of the mechanical load in electrical interfaces. Maintaining a sufficiently large mechanical contact load in an electrical contact is the major requisite to maintaining reliability in an electrical connector. The major reason for this requisite is addressed below.

The primary criterion for a reliable electrical connection is a sufficiently low electrical contact resistance between the attached conductors and the connector. For connectors that are attached mechanically to wire or cable conductors, such as bolted, pin-in-socket, insulation-displacement connectors (IDCs), compression or wedge connectors, low contact resistance necessitates the application of a sufficiently large mechanical contact force between the connector and the conductors. Furthermore, this contact force must be maintained during the service life of the connector to preclude contact degradation. Compression connectors are particularly susceptible to loss of mechanical contact load. Compression connectors are mechanically squeezed over conductors. Another version of compression connectors relies on the pressure generated by a screw or bolt driven into direct contact with the wire or conductor strands to produce electrical contact between the conductor and a metal barrel. Neither type of compression connector is specifically designed to maintain a selected contact load at electrical interfaces with conductors during service. This contrasts with bolted, pin-type separable connectors, IDCs and wedge connectors where the contact load is maintained through release of elastic energy stored in spring inserts such as Belleville washers and similar components.

SUMMARY OF THE INVENTION

In accordance with the invention, there is provided a reliable electrical connection between electrical conductors and an electrical connector, preferably a compression or crimp connector, utilizing an elastic-energy storage device fabricated from a strong metal or a polymeric material, or a combination of these two or any other materials capable of sustaining mechanical deformation but without loss of capability of storing acceptable amounts of elastic energy. On compression of the sleeve/barrel of the connector over the conductor (s), the elastic-energy storage device springs back to generate and maintain a sufficiently large contact force between the conductors and the connector to mitigate the deleterious effects of contact degradation mechanisms such as stress relaxation, metal creep, differential thermal expansion etc., all of which act to decrease contact load and lead to electrical failure of the connector.

It is the principal object of the invention to provide a novel and improved electrical connection in a compression and crimp connector of any dimensions which may be employed in a number of different ways, and which is simple in assembly and provides an efficient electrical connection characterized by nearly-constant mechanical contact load, by low electrical contact resistance and thus by resistance to mechanical vibrations and other environmental stresses that degrade the mechanical and electrical stability properties of all interfaces in the joint. The use of a similar elastic-energy storage device may also be contemplated in other types of connections involving for example bolted joints.

Accordingly, the invention provides a connector comprising an internal resiliently flexible spring within a compression or crimp connector, or in a bolted compression connector, in contact with the electrical conductors to be connected electrically wherein the spring is capable of being mechanically deformed during compression of the connector and wherein the spring is capable of maintaining its elastic resilience and elastic springback properties to generate and maintain the required compression force on the conductor.

Preferably, the spring is a metal mechanical spring internally within the compression or crimp connector, or in a bolted compression connector, in contact with the electrical conductors to be connected electrically.

Further, the force generated by springback of the spring is determined by the dimensions and materials properties of the spring which are preferably, determined by the dimensions of the compression or crimp connector.

Preferably, the material of which the spring is constructed must be of such strength that any permanent mechanical deformation sustained during crimping does not compromise its capability to store an acceptable amount of energy in elastic deformation and wherein the surface of the spring may be modified to enhance electrical conductivity properties and resistance to oxidation and galvanic corrosion.

In alternative embodiments, the connector has a plurality of metal mechanical springs as hereinabove defined in contact with the electrical conductors to be connected electrically wherein the springs act co-jointly and are capable of being mechanically deformed during compression of the connector and wherein the springs are capable of maintaining their elastic resilience and elastic springback properties to generate and maintain the required compression force on the conductor.

Preferably, the force generated by springback of the springs is determined by the dimensions and materials properties of the springs, which plurality of metal mechanical springs have dimensions determined by the dimensions of the compression or crimp connector.

Preferably, the metal mechanical springs are of a material of which the springs are constructed to be of such strength that any permanent mechanical deformation sustained during crimping does not compromise their capability to store an acceptable amount of energy in elastic deformation and wherein the surface of the springs may be modified to enhance electrical conductivity properties and resistance to oxidation and galvanic corrosion.

In alternative embodiments, a connector as hereinabove defined comprises one or more springs made of a resiliently flexible material such as, for example, a polymer material inserted in a compression or crimp connector, in contact with the electrical conductors to be connected electrically wherein the spring is capable of being mechanically deformed during compression of the connector and wherein the spring is capable of maintaining its elastic resilience and elastic springback properties to generate and maintain the required compression force on the conductor.

The polymeric spring provides the force generated by springback of the spring determined by the dimensions and materials properties of the spring and the dimensions of the compression or crimp connector.

The polymeric spring wherein the material of which the spring is constructed must be of such strength that any permanent mechanical deformation sustained during crimping does not compromise its capability to store an acceptable amount of energy in elastic deformation.

In a further aspect, the invention provides a spring for use in a connector as hereinabove defined.

BRIEF DESCRIPTION OF THE DRAWINGS

In order that the invention may be better understood, preferred embodiments will now be described by way of example only, with reference to the accompanying drawings, wherein.

DETAILED DESCRIPTION OF PREFERRED EMBODIMENTS

Figure 1:
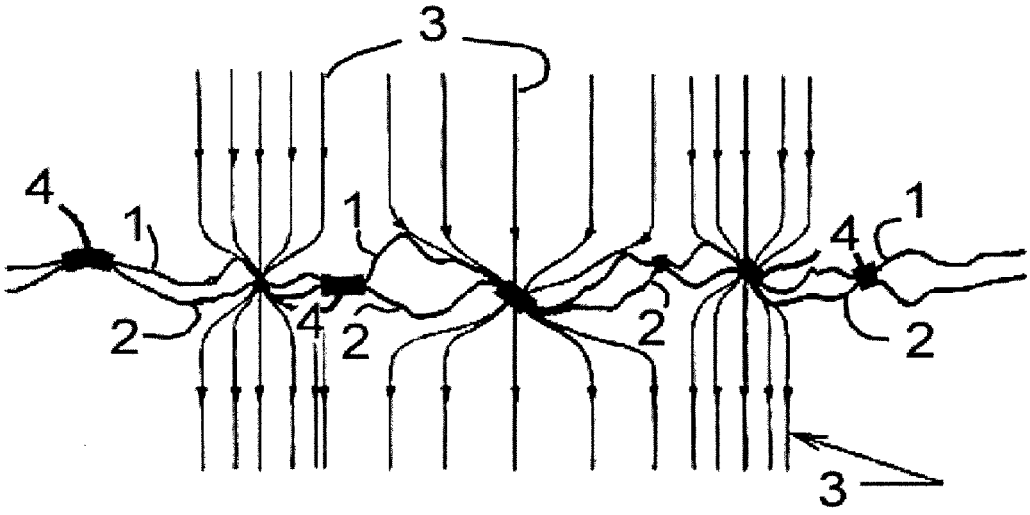
FIG. 1 is a diagrammatic illustration of a contact interface between two solid surfaces, showing that true contact is made only where the summits of surface asperities from each surface touch the mating surface. Electrical current passes through small contact spots at asperity summits.

In respect to the true area of electrical (metal-to-metal) contact in a connector, all surfaces are rough on the microscale and consist of micro-peaks and micro-valleys on the surface. The electrical interface of a connector with a conductor is generated at localized small contact spots identified as 4 between the two surfaces illustrated as 1 and 2 in FIG. 1 [4]. The nature of this mechanical contact dictates that the area of true contact between connector and conductor is very small. As illustrated schematically as 3 in FIG. 1, electrical current passes from one surface to the other through contact spots at the micro-peaks, provided the surfaces are free of electrically-insulating surface films. In the presence of insulating films, contact spots conduct electrical current only if the surface films are fractured or dispersed. Thus the area of true electrical contact with conductors in a mechanically-installed connector may vary from much less than 1% to several % of the area of nominal contact, depending on the application. Because the area of true contact is proportional to the mechanical contact force, one of the fundamental requirements for good connector performance is the generation of as large a true area of metal-to-metal contact as practicable through the application of a sufficiently large mechanical contact load. The contact force causes partial flattening of all surface asperities in contact.

In any electrical connector, electrical integrity is constantly threatened by the disrupting effects of mechanical vibrations, mechanical creep or stress relaxation, varying temperatures etc., all of which conspire to generate micro-displacements along the electrical interfaces. These displacements cause a loss of the electrical contact spots illustrated in FIG. 1 by displacing or shearing off contacting asperities, or by allowing the ingress of electrically-insulating surface films (such as oxide or corrosion films) within contact spots between mating surfaces. The amplitude of these displacements becomes relatively large (a few tens of micrometers) if the contact force in the connector is not sufficiently high thus leading to a relatively loose mechanical interface. The loss of electrical contact spots diminishes the number of current pathways across the electrical interfaces and thus leads to an increase in the electrical contact resistance between the mating surfaces. This increases Joule heating of electrical contact spots and causes eventual catastrophic failure of the electrical connections [5]. Thus, the major challenge in electrical connector design is the identification of ways to maintain a sufficiently large contact force in the electrical contact regions during connector service to preserve an acceptably large area of electrical contact and mitigate the nefarious effects of electrical degradation mechanisms. Although there are techniques for maintaining a large contact force in many types of connectors, such techniques are lacking for compression- (or crimp-) type connectors. This invention relates to a simple method of maintaining a large contact force in a compression (or crimp) connector and of enhancing the reliability of the connector. A detailed description of the invention requires a brief review of the major electrical connector technologies and the techniques used to maintain a large contact force in the associated electrical interfaces.

Mechanically-installed electrical connectors and associated techniques for storing elastic energy and maintaining a large contact force of the prior art and as a backdrop to the present invention, this section focuses on techniques used by selected connector technologies to maintain a selected contact force in electrical interfaces during the expected service life of the connector. This will be contrasted with the absence of such techniques in compression (or crimp) connectors, which will emphasize the urgent need for the use of elastic-energy storage inserts in compression connections. Because of the large number of variations in the design of connectors associated with each of the connector technologies described below, the main features of each technology will be described in relation to a specific illustrative example. There are at least five technologies associated with mechanically-installed electrical connectors that are relevant to the present invention: (i) the bolted connector technology whereby electrical contact with conductors is achieved using a selected bolted- or screwed joint arrangement, as illustrated schematically in the example of FIG. 2 (ii) the pin-in-socket connector in which conductors are attached separately to a pin and to a female receptacle and an electrical connection is made by sliding the pin into the socket, as illustrated by examples A, B and C in FIG. 3, (iii) the insulation displacement connector (IDC) whereby an insulated conductor is installed on a connector by sliding in a narrow metal slot in the terminal of the connector; the edges of the metal slot remove the wire insulation by friction and shear forces, thus providing an electrical connection with the slotted terminal, as illustrated in FIG. 4 (iv) the fired-wedge technology whereby a wedge is inserted between two conductors using a cartridge-activated tool, thus pushing the conductors into the grooves of a holding metal clamp of the connector, as illustrated schematically in FIG. 5, and (v) the compression (or crimp) technology whereby segments of the connector are mechanically deformed and compressed (or crimped) over the conductors to be joined, as illustrated by examples 6A, 6B and 6C in FIG. 6.

Figure 2:
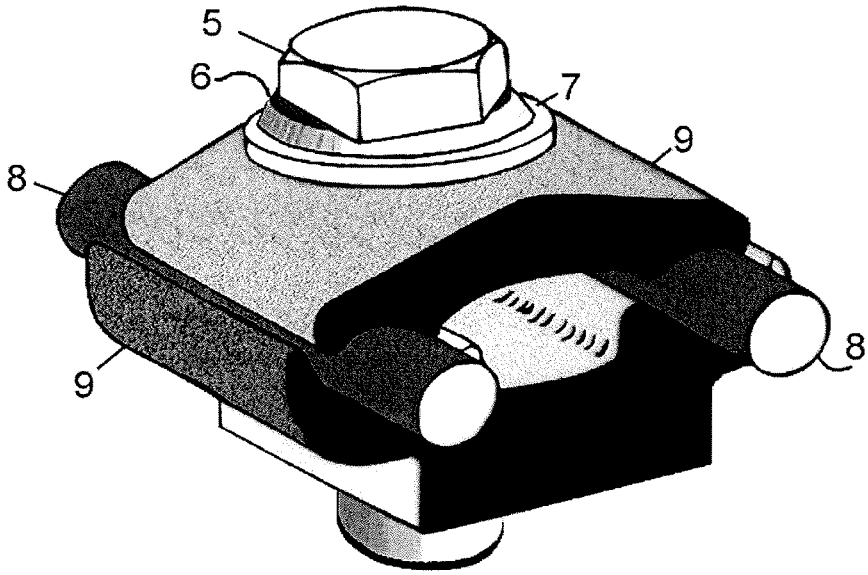
prior art Fig. 2
FIG. 2 is a diagrammatic perspective view of a bolted connector according to the prior art showing the use of a bolt tightened over a Belleville washer positioned over a flat washer to prevent mechanical damage to the connector, is only partly flattened and stores elastic energy.

In a bolted or screwed connector 9 in FIG. 2, a relatively steady contact force with the conductors can be maintained through the use of an elastic-energy storage device such as a Belleville washer 6 inserted between the bolt or screw head 5 and the connector, as illustrated schematically in FIG. 2. The Belleville washer is situated over a flat washer 7 to prevent indentation damage of the connector by the curved washer ends under the application of the contact force. Under the action of thermal excursions in service, changes in mechanical stress in electrical interfaces due to differential thermal expansion of the connector components (and particularly the bolt or screw) and the conductors 8, are minimized since the Belleville washer accommodates displacements stemming from differences in thermal expansion of the connector hardware. Maintaining a nearly steady contact force on the conductors 8 through the use of a Belleville washer or a similar elastic-energy storage device greatly enhances the performance reliability of bolted or screwed electrical connectors [4-7]. Experimental evidence also shows that the absence of an elastic-energy storage device such as a Belleville washer greatly degrades the performance of bolted electrical connections exposed to thermal cycling [5]. In the absence of an energy-storage device, the same connector deteriorates relatively rapidly due to the large excursions of thermally-induced mechanical contact stresses during heating cycles and the subsequent creep of the conductor/connector materials with an ensuing loss of contact force [5].

Figure 3A:
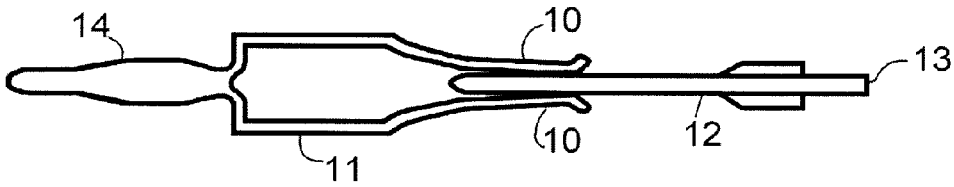
prior art Fig. 3A
FIGS. 3A-3C shows three diagrammatic cross-sections in examples of pin-in-socket connectors, according to the prior art, wherein in 3A, the elastic energy of the connection is stored in the receptacle; in 3B, the elastic energy is stored in the elastically-compliant "eye-in-the-needle" pin; and 3C shows an alternative connector having an internal spring.
Figure 3B:
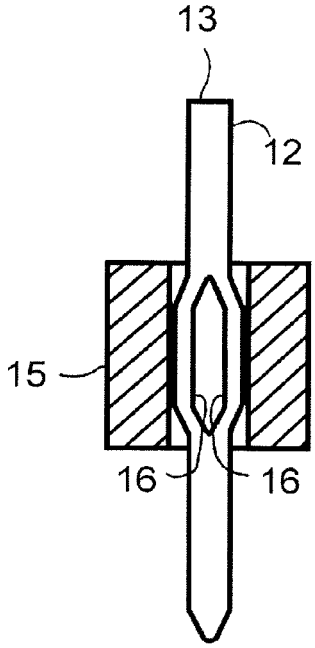
prior art Fig. 3B
Figure 3C:
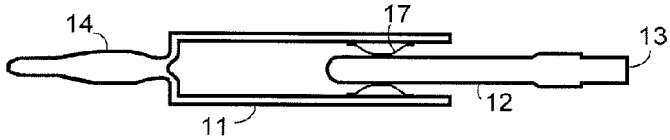
prior art Fig. 3C

Pin-in-socket connectors are often referred to as post-in-receptacle, plug-in, press-fit, card-edge etc. connectors. Other descriptive terms may be applied but they all refer to a separable electrical connection. The connector cross-section identified in FIG. 3A illustrates one of the wide variety of connector designs that have been developed to address the broad range of application environments and requirements. This connector design illustrates the simplest type of receptacle consisting of two cantilever springs 10 attached or extending from the receptacle body 11, that are pushed apart when the pin 12 is inserted to generate a specified contact force. Electrical conductors are often either soldered or crimped to the ends 13 and 14 respectively of the pin and the receptacle. The socket springs represent the elastic-energy storage device designed to maintain the specified contact force over a long time interval in service where the connector may be subjected to a changing service environment, including large temperature variations. The connector cross-section identified in FIG. 3B illustrates another widely-used press-fit arrangement wherein the pin 12 designed to include a spring section 16 that deforms elastically within the receptacle 15 to maintain an acceptable contact force [8]. Electrical connection to the wire is achieved by attaching the wire to the pin 12 by crimping or by soldering at the back end 13 of the component. The connector cross-section identified in FIG. 3C illustrates another widely-used arrangement wherein an internal spring 17 is located within the connector housing 11 to achieve a desired contact force with the pin 12 and maintain this force during service at the pin-socket interface and thus maintain a low electrical contact resistance in the separable connection [see for example reference [9]]. Electrical connection of a wire to the pin 12 is achieved by attaching the wire by crimping or by soldering at the back end 13 of the component. Similarly, electrical connection of a wire to the receptacle is achieved by attaching the wire by crimping or by soldering at the back end 14 of the receptacle. In all pin-in-socket connectors, neither the pin nor the socket is plastically deformed intentionally.

Figure 4:
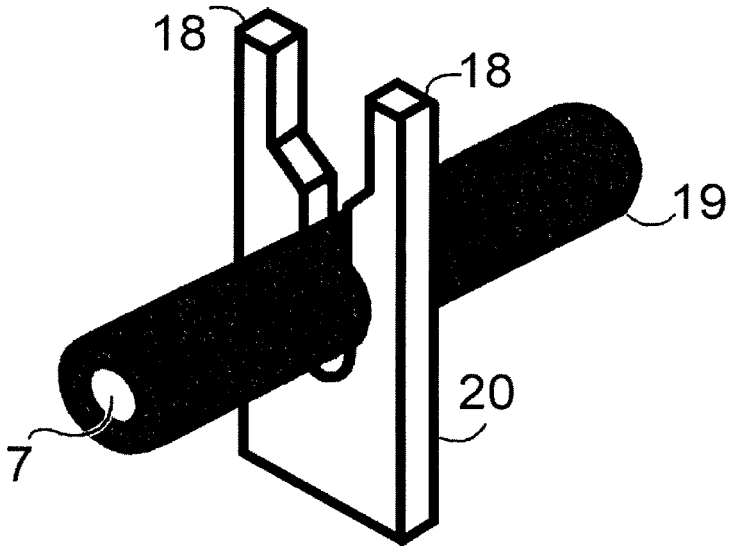
prior art Fig. 4
FIG. 4 shows a diagrammatic perspective view of an insulation displacement connector (IDC) according to the prior art, wherein the elastic energy is stored in the elastically-compliant receptacle in contact with the conductor after cutting and displacement of the wire insulation by the receptacle edges.
Figure 5:
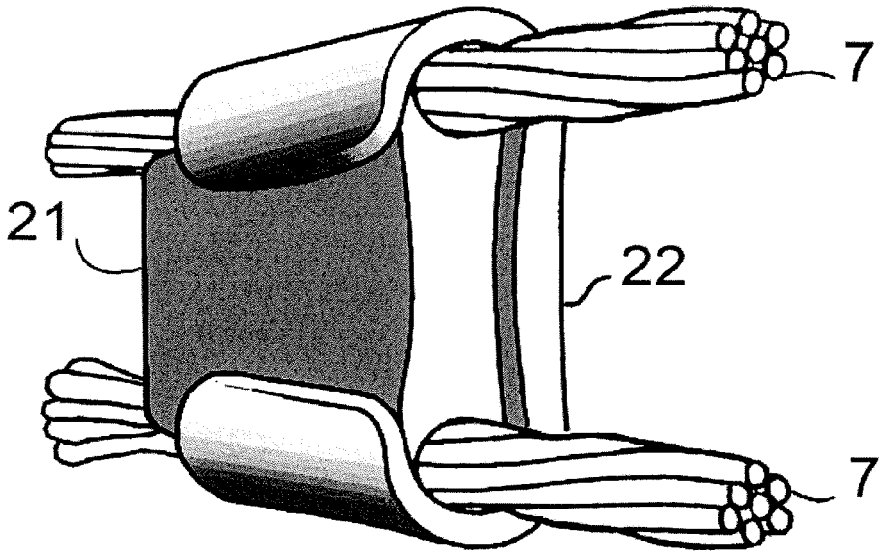
prior art Fig. 5
FIG. 5 shows a diagrammatic perspective view of a fired-wedge connector, according to the prior art, wherein a wedge is inserted between the two conductors using a cartridge-activated tool and the elastic energy is stored in the elastically-stretched C-clamp holding the two conductors in place after insertion of the wedge.

In Insulation Displacement Connectors (IDCs) illustrated in FIG. 4, the wire insulation 19 is cut and displaced longitudinally along the conductor 7 by metal contact beams 18 as the wire is inserted into the terminal. The contact beams 18 that displace the insulation are part of the receptacle 20. The electrical contact is established between the two beams 18 and the metal conductor. The conductor 7 is mechanically deformed under the action of the contact force. The ensuing residual force on the conductor is determined by the deflection of the two beams and by the geometry of the contact beams 18 [2]. The high elastic stiffness of the beams generally insure that a large amount of elastic energy is stored in the deflected beams to allow the beams to maintain an acceptable contact force on the wire in the face of possible incremental decrease in the wire cross-section due to mechanical creep during service.

Fired wedge-connectors are used most commonly to tap electricity from electrical power lines. In these applications and as illustrated schematically in FIG. 5, the connector consists of a metal wedge 21 located between the feed and tap cables 7 situated at opposite ends of a C-shaped metal component 22. The wedge 21 and C-member 22 are usually fabricated from strong aluminum alloys. Because fired wedge-connectors are used in open urban, rural, industrial, and seacoast environments, they must withstand the effects of high winds, pollution, and other harsh environmental factors. For this reason, the mechanical and electrical interfaces generated with the feed and tap conductors 7 are mechanically secured by inserting the wedge between the two conductors with sufficient force to cause plastic deformation of the C-member 22. This deformation occurs in a direction normal to that of the wedge motion, as the C-member 22 spreads laterally to accommodate the wedge to its full insertion distance. The deformation path is such that a large elastic restoring force is generated within the C-member 22 that secures the conductors 7 mechanically in place [10, 11]. The wedge is installed using a tool of special design actuated by a powder cartridge [11]. The elastic energy stored in the C-member 22, which acts to maintain a near-constant contact force on the conductors in service, is the main reason for the overwhelming performance superiority of fired-wedge connectors over all other connector types used in power-tap applications [12, 13].

Figure 6A:
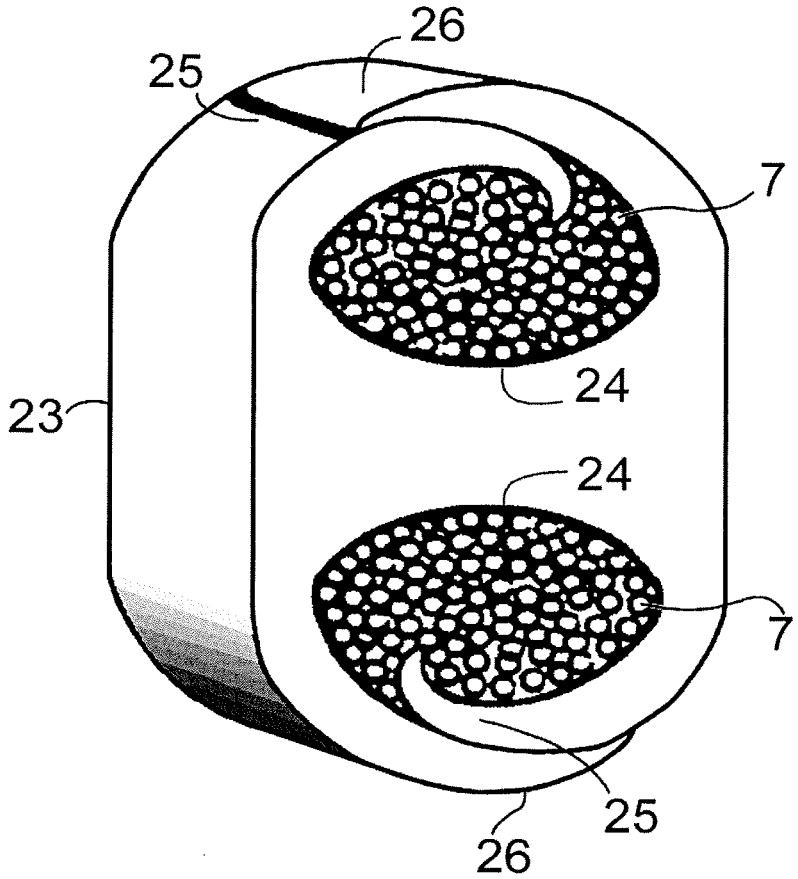
prior art Fig. 6A
FIGS. 6A-6C show three diagrammatic perspective or sectional views of examples of compression (or crimp) connectors, according to the prior art. The connector in FIG. 6A is a representation of an "H-type" compression connector to form an electrical connection between two separate stranded conductors. In the connector, two partitions are bent and compressed over the conductor on each side of the connector. The connector in FIG. 6B is a schematic representation of a compression splice connecting two stranded conductors located in series with one another, while the connector in 6C is schematic representation of a crimp connector used for relatively small stranded wires in electronic connection applications to provide an electrical connection between a wire and a plate. The wire is crimped to the connector and the connection is attached to an electrical terminal via a screw connection. Note that in each of 6A, 6B and 6C, the elastic energy stored in the connection is minimal as described in the text.

In compression (or crimp) connections, one example of which is illustrated in FIG. 6A, bare solid or stranded conductors 7 are interconnected through the metal body of the connector 23 by locating one end of each conductor into the respective recesses 24 of the connector. The connector is adapted with two pairs of opposing legs extending in opposite directions from the main body 23 as described in the example of Schrader and Nager [35]. For connector installation, the legs on each side of connector 23 are mechanically folded over the respective conductors so that leg 25 is curved inwardly with respect to the second leg 26 which is wrapped over the first leg to close the connection. The folding and subsequent mechanical compression of the conductors by the folded legs 25 and 26 is carried out using a large compressive force generated either by a hand compression tool or by a high-power compression tool. Connector installation causes extensive permanent mechanical deformation of the connector and conductors and mechanically locks the deformed conductor in place within the connector.

Figure 6B:
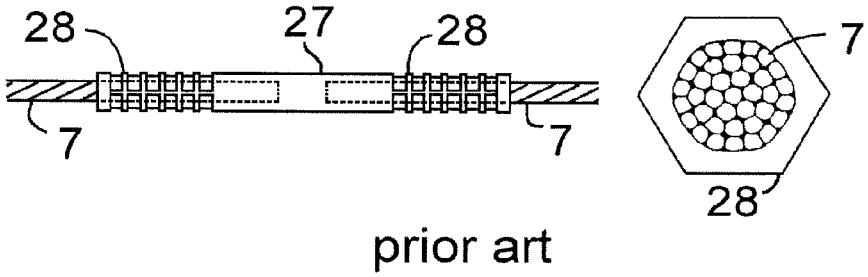

Another example of a compression connection is the splice connector illustrated in FIG. 6B where the two stranded conductors 7 are connected in series through the metal splice 27 after inserting the conductors into the respective ends 28 of the connector. The connector ends 28 are then mechanically compressed over each conductor using a large compressive force generated either by a hand-operated or by a high-power compression tool. Connector installation causes extensive permanent mechanical deformation of the connector and conductors and mechanically locks the deformed conductor within the connector. Although the example of FIG. 6B illustrates an example where the compression die is hexagonal, compression dies of circular and other shapes are often used [18].

Figure 6C:
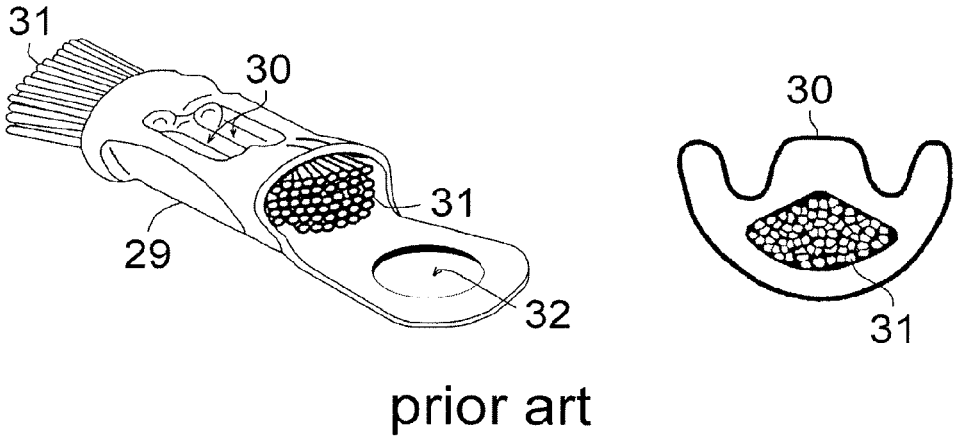

Another example of a compression connection often used with relatively small conductors with fine strands is the crimp in the connector illustrated in FIG. 6C. In this example, the small-strand conductor 31 is attached to the connector for interconnection with a terminal block, a printed circuit board or other electrical device by attachment with a screw through the screw-hole 32. The attachment hole 32 is located on the main connector body 29. In this illustrative example, the connector is crimped over the conductor to achieve the W-shaped deformation 30, although the conductor is not necessarily deformed to the same shape. Various crimp deformation shapes are used in practice to attempt achieving a larger residual contact force after release of the crimping tool [2], but a measurement of the actual residual contact force in any crimp connection of any shape or size has never been reported. As was the case with the connectors in FIGS. 6A and 6B, connector installation on the conductor causes extensive permanent mechanical deformation of the connector and conductors and mechanically locks the deformed conductor within the connector. Several compression connector types are described in references [19-43].

Figure 7A:
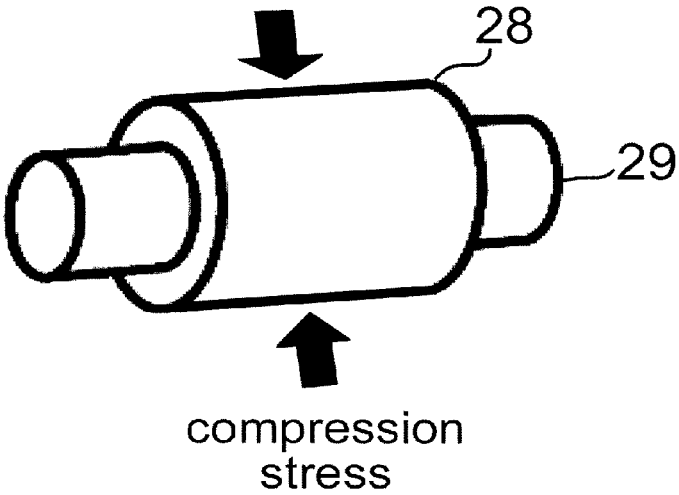
FIG. 7A is a diagrammatic perspective view of an idealized compression connector consisting of a cylindrical solid conductor and a cylindrical barrel.

In contrast with bolted connectors, pin-in-socket connectors, IDC connectors and fired-wedge connectors that allow for elastic-energy storage via geometrical design or the use of inserts, the amount of stored elastic energy available in the deformed connection of the compression or crimp connectors in FIGS. 6A, 6B and 6C is minimal. Thus the capability of the connector to maintain or restore an acceptable contact force at electrical interfaces after compression is also minimal. A recent analysis of the residual force in the electrical interface of a compression connector indicates that this contact force is determined by the relative elastic springback of the deformed barrel and conductor on release of the crimping tool [14]. A heuristic way of understanding the effect of elastic springback is to consider the simple cylindrical compression connection illustrated in FIG. 7A consisting of a solid conductor 29 compressed in a cylindrical barrel 28. If the conductor and barrel are visualized as separate "free" isolated objects while still in the state of maximum deformation generated by the crimping tool, then on release of the crimping tool, the visualized "free" isolated objects will spring back elastically to radial dimensions associated with the absence of any applied external load. Such springback will cause the radius of the "free" conductor to increase from the compressed state 30 to the released state 31 by an amount $\Delta a_{C,0}$, as illustrated respectively in FIG. 7B. Similarly, the radius of the "free" barrel bore increases from the compressed state 32 to the released state 33 by an amount $\Delta a_{B,0}$ as illustrated respectively in FIG. 7C. If the conductor and barrel are now visualized as reunited, it is clear that an acceptable compression connection is achieved only if $\Delta a_{C,0}$ exceeds $\Delta a_{B,0}$. In the connection, the final radial extension of the conductor in the barrel will be smaller than $\Delta a_{C,0}$ since the conductor is now constrained by the barrel. By the same token, the radial extension of the barrel bore will be larger than $\Delta a_{B,0}$ since the condition $\Delta a_{B,0}<\Delta a_{C,0}$ subjects the barrel to an internal pressure generated by the conductor. Thus the conductor will be in a state of compressive stress whereas the barrel will be under tensile stress.

Figure 7B:
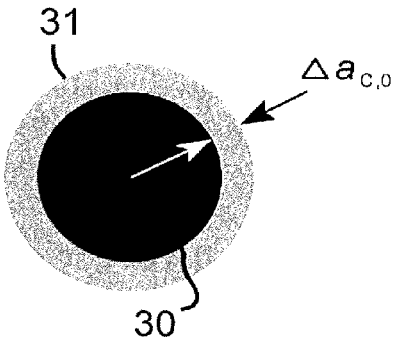
FIG. 7B shows the springback amplitude $\Delta a_{C,0}$ of the conductor in FIG. 7A under conditions where it is unconstrained, on release of the compression force
Figure 7C:
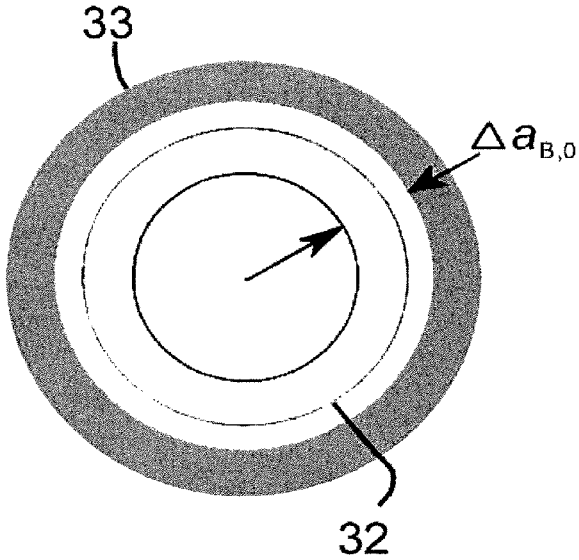
FIG. 7C shows the springback amplitude $\Delta a_{B,0}$ of the barrel in FIG. 7A under conditions where it is unconstrained, on release of the compression force.
Figure 8:
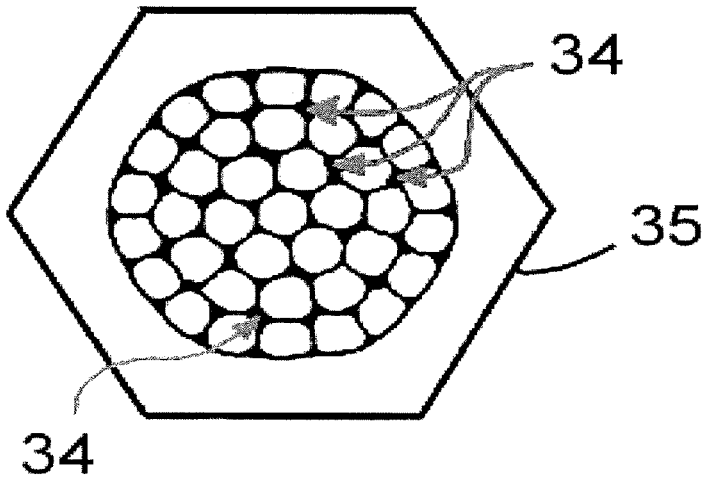
prior art Fig. 8
FIG. 8 is a diagrammatic cross-sectional view of a compression connector, according to the prior art; to illustrate the compaction of wire strands.
Figure 9:
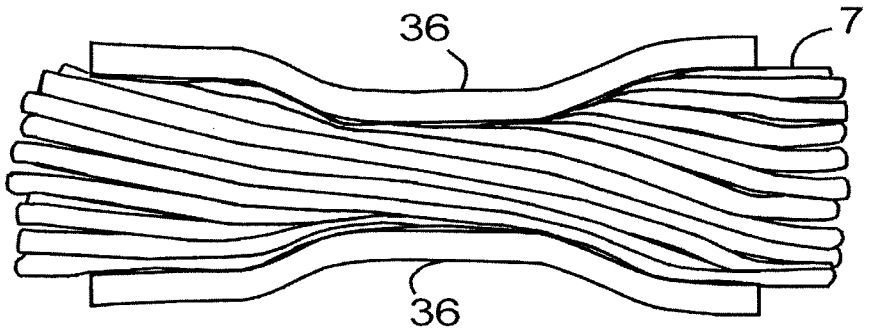
prior art Fig. 9
FIG. 9 shows a schematic representation of the deformation of a multi-stranded conductor, according to the prior art along a compression barrel after compression.

In practice, the idealized situation illustrated in FIGS. 7B and 7C seldom happens because most electrical conductors consist of stranded wires, as already illustrated schematically in FIG. 6. With such conductors, the amount of elastic springback expected from the conductor is small since the springback from individual wire strands is accommodated in part by strand expansion into interstrand voids 34 illustrated schematically in the compression connector 35 shown in FIG. 8. This decreases the net springback displacement towards the barrel on release of the compression tool. In addition, the amplitude of springback of the conductor strands and the barrel depends on physical and metallurgical properties of the component materials such as elastic modulus, yield strength, hardness and other factors including component dimensions. For example, a relatively soft conductor will deform plastically more than a strong conductor and will therefore be less capable of storing elastic energy to be released on springback. The magnitude of the contact load on a conductor in a compression connector thus depends sensitively on differences in the physical and metallurgical properties of the material of the connector and those of the conductors [14]. Because of the near-absence of a capability to store elastic energy, a compression connection in which the conductors remain in a slight compressive state immediately after compression does not necessarily maintain the compression load over time due to temperature-activated mechanisms such as creep, stress relaxation etc. It is emphasized that although a conductor may be physically locked in place in a compression connector as illustrated in FIG. 9, and may thus be characterized by a relatively large pullout strength, it does not necessarily follow that the contact force is large at all electrical interfaces. The pullout strength may be large since the effective strength is determined in part by the force required to squeeze the conductor 7 out of the connector through narrow segments 36 of the deformed compression barrel. Indeed, extensive computer modeling of compression joints have revealed that the residual contact force in the deformed interfaces after release of the compression tool is negligibly small [15, 16]. Although claims are made that the electrical contact in a compression joint stems from cold welding between wire strands and the connector [2], such claims ignore a large body of literature that indicates that there are two major requisites to achieve significant cold welding between compressed metal surfaces [17]: (i) the contacting surfaces be deformed by at least 40-60% and (ii) the surfaces must be metallurgically clean to preclude interference by contaminant surface materials to the formation of a cold metallurgical bond. In practice, wire-strand and connector deformation are seldom sufficiently large, and contacting surfaces are seldom sufficiently clean, to achieve any significant amount of metallurgical bonding in a compression joint [2, 15].

Compression connectors are not designed to offset effects of stress relaxation, metal creep, differential thermal expansion and other mechanisms that may act synergetically to diminish contact load. The absence of a capability for maintaining contact load is responsible for the inferior performance of compression connectors compared with that of bolted, pin-in-socket, IDC and wedge connectors where this capability exists [2, 13, 14]. Examples of the inability of conductor strands to remain compacted in a compression barrel after release of the compression tool due to the absence of elastic energy storage has been illustrated in the literature [18]. The absence of recommendation or use of an internal spring of any type in a commercially-available compression connector since the inception of these types of connectors, has stemmed from two major factors: (i) a lack of appreciation of fundamental issues of the mechanics of deformation of solid bodies that relate to residual contact load in a compression joint, namely the difference in relative springback of conductors and compression barrel; in that respect, the work reported in reference [14] represents the first attempt to provide a simple analytical model of the generation of a residual contact force in a compression connector, and (ii) a presupposition that the severe deformation undergone by a compression barrel and the enclosed conductors must necessarily imply, by the very extent of the visible deformation, that the residual contact force must be large. This premise is not necessarily valid.

The present invention describes a novel fundamental approach to using one or several elastic-energy storage devices in a compression connector to maintain a large contact load in electrical interfaces and promote long-term reliability of the connector wherein a spring is introduced in the compression connector to store elastic energy in the connection. One embodiment of such an elastic-energy storage device in a compression splice connection of the type illustrated in FIG. 6B is shown schematically in FIG. 10. In this case the spring insert 37 consists of a thin tube fabricated from a spring material of high strength and of such dimensions that it is capable of being mechanically deformed without losing its elastic resilience and thereby capable of storing sufficient elastic energy after deformation to maintain an acceptably large contact load on the conductor after compression. The spring may be permanently deformed but is capable of sufficient springback to generate the required compression force on the conductor. The force generated by springback of the energy-storage device 37 is determined by the dimensions, including thickness, and materials properties of the device. These dimensions will vary with the dimension and geometry of the compression connector. In the embodiment illustrated in FIG. 10, the spring material of 37 must be of such strength as to sustain less permanent mechanical deformation than either the conductor 7 or the connector 35 during compression to provide a capability to store a large amount of energy in elastic deformation. If necessary, the spring 37 may be coated with materials that enhance electrical conductance properties and resistance to dry corrosion and galvanic corrosion. A perspective view of the compression connector fitted with the spring insert and before installation is shown in FIG. 11.

Figure 10:
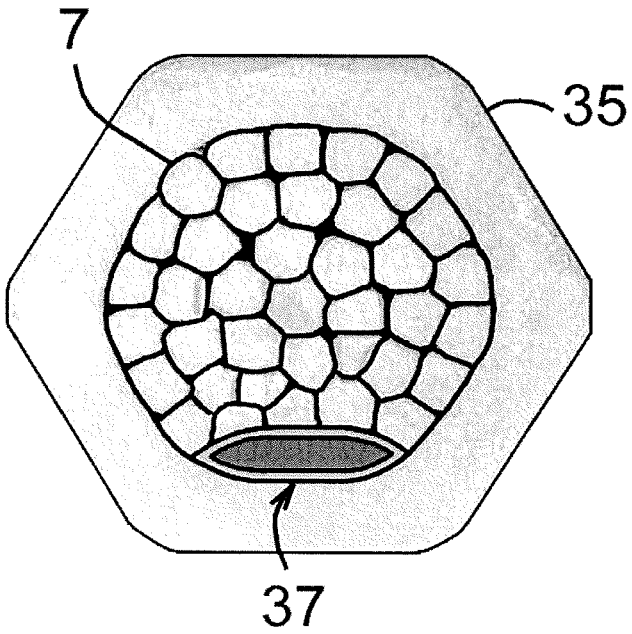
FIG. 10 is a diagrammatic cross-section of a compression connector, according to the present invention which illustrates the compaction of wire strands in which an elastic-energy storage device consisting of a flattened cylinder made of a resiliently flexible strong metal is present.
Figure 11:
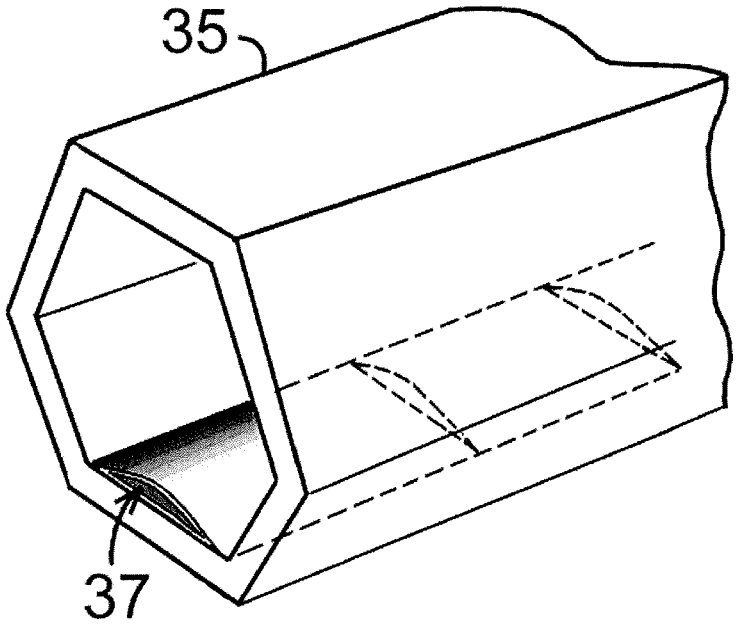
FIG. 11 is a diagrammatic perspective view of an elastic-energy storage device consisting of a flattened metal cylinder located on one inner surface of the hexagonal compression barrel of a compression connector, according to the invention.

In the embodiment illustrated in FIGS. 10 and 11, the spring 37 may also be made from an elastomeric or other non-metallic but elastically-pliable material capable of imparting permanent deformation to the conductor while maintaining its elastic resilience for the expected service life of the connector and thus maintaining its elastic springback properties and an acceptably large contact load on the conductor. The embodiment using an elastomeric material for the spring insert is different from an embodiment for fine wires by Weidler [32] whereby the intent of the elastomeric material is to hold fine wires in place and minimizing deformation of the wires to mitigate breaking of varnish insulation on the wires in a compression joint. In all embodiments, the spring material must be resistant to mechanical creep or stress relaxation under the action of a large mechanical stress. In all embodiments, the spring insert may be shorter or longer than the length of the compression connector. More than one spring insert may be used in a compression joint.

Figure 12:
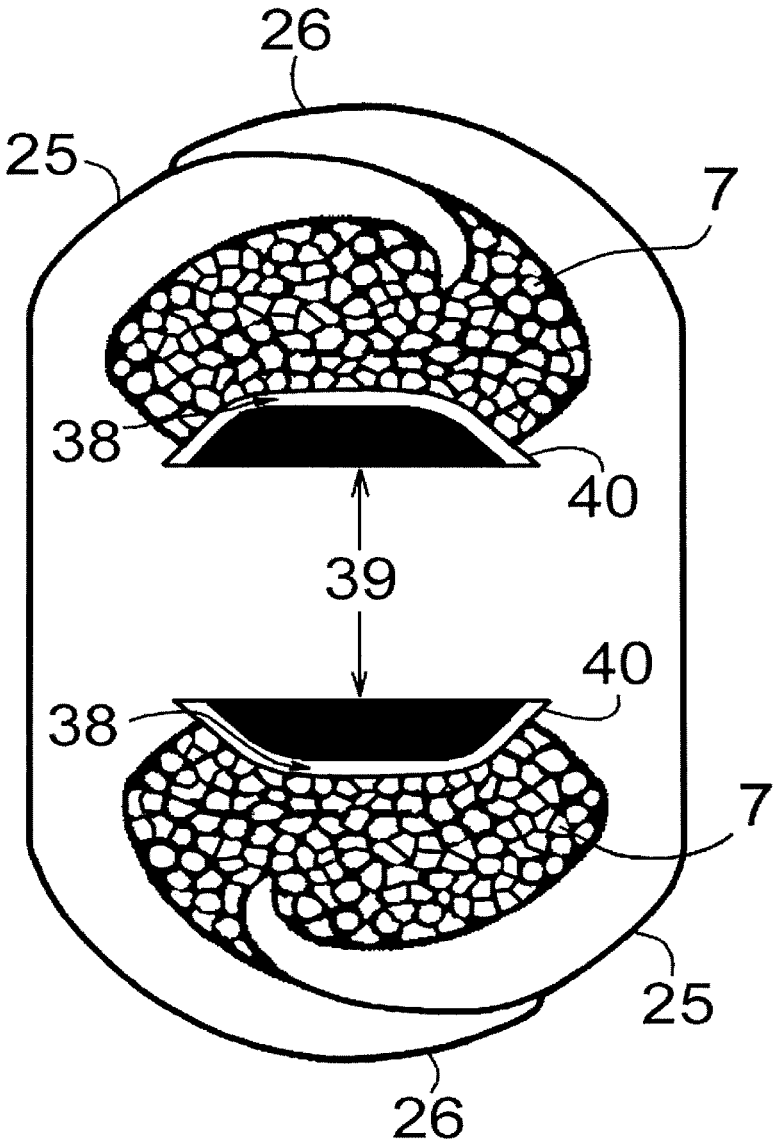
FIG. 12 is a diagrammatic sectional view of an "H-type" compression connector, according to the invention connecting two stranded conductors and adapted with two elastic-energy storage devices.

Another example using a different embodiment of the elastic-energy storage insert is illustrated schematically in FIG. 12 in an H-compression connector of the type illustrated in FIG. 6A [35, 36, 38, 42]. In this embodiment each insert consists of a bent strip 38 fabricated from a spring material of high strength and of such dimensions that it is capable of storing sufficient elastic energy after deformation to maintain an acceptable contact load on each conductor after compression. Each spring is located in a groove 39 and is held in place in the connector by the dovetailed partitions 40 of the groove. On application of the compression force to close the legs 25 and 26 and install the connector to join the conductors 7, each spring is deformed but is capable of maintaining its elastic resilience and sufficient springback to generate and maintain the required compression force on each conductor. The force generated by springback of the bent strip 38 is determined by the dimensions and materials properties of the strip. If necessary, the spring 38 may be coated with materials that enhance electrical conductance properties and resistance to dry corrosion and galvanic corrosion. In the embodiment illustrated in FIG. 12, the spring material must be of such strength that any permanent mechanical deformation sustained during crimping does not interfere with its capability to store a large amount of energy in elastic deformation. In the embodiment illustrated in FIG. 12, the spring 38 may also be made from an elastomeric or other non-metallic but elastically-pliable material capable of imparting mechanical deformation to the conductors and connector body and remaining elastically deformed for the expected service life of the connector without losing springback properties.

Figure 13:
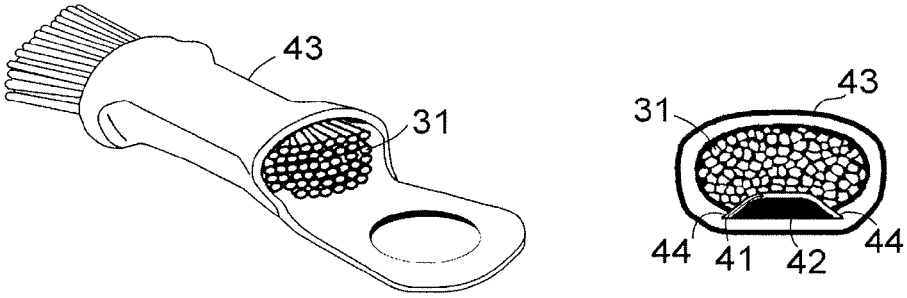
FIG. 13 represents a diagrammatic perspective view and a cross-sectional view of a crimp connector, according to the invention, used for relatively small stranded wires in electronic connection applications, adapted with one metal elastic-energy storage device.

Yet another example using a different embodiment of the elastic-energy storage insert is illustrated schematically in FIG. 13 in a small crimp connector of the type illustrated in FIG. 6C [2, 8]. In this embodiment the insert also consists of a bent strip 41 fabricated from a spring material of high strength and of such dimensions that it is capable of storing sufficient elastic energy after deformation to maintain an acceptable contact load on the small-strand conductor after compression. The spring is located in a groove 42 on one side of the crimp connector 43 and is held in place in the connector by the dovetailed partitions 44 of the groove. On application of the compression force to attach to the conductor 31, the spring is deformed but is capable of maintaining its elastic resilience and sufficient springback to generate and maintain the required compression force on the conductor. The force generated by springback of the bent strip 41 is determined by the dimensions and materials properties of the strip. If necessary, the spring 41 may be coated with materials that enhance electrical conductance properties and resistance to dry corrosion and galvanic corrosion. In the embodiment illustrated in FIG. 13, the spring material must be of such strength that any permanent mechanical deformation sustained during crimping does not compromise its capability to store a large amount of energy in elastic deformation. In the embodiment illustrated in FIG. 13, the spring may also be made from an elastomeric or other non-metallic but elastically-pliable material capable of imparting mechanical deformation to the conductors and connector body and remaining elastically deformed for the expected service life of the connector without losing springback properties.

Figure 14:
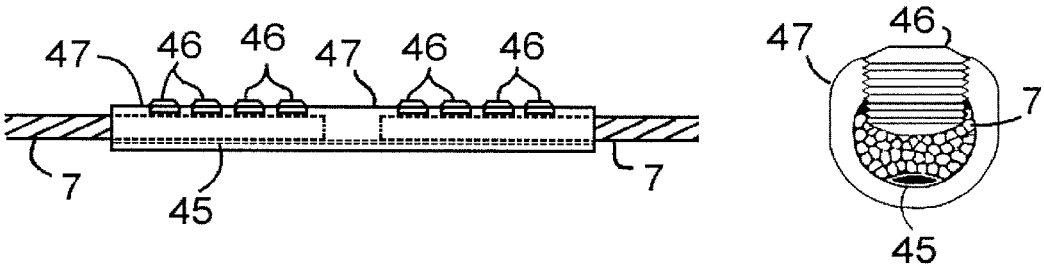
FIG. 14 represents diagrammatic and section views of a bolted compression splice connecting two stranded conductors, according to the invention, located in series with one another. The connectors are adapted with one metal elastic-energy storage device.

Yet another example using a different embodiment of the elastic-energy storage insert is illustrated schematically in FIG. 14 in a bolted compression connector [18]. In this embodiment the insert consists of a hollow tube 45 fabricated from a spring material of high strength and of such dimensions that it is capable of storing sufficient elastic energy after deformation to maintain an acceptable contact load on the small-strand conductor after compression by the bolt. The spring 45 is located across from the ends of the bolts 46 on the inner surface of the bolted compression connector 47. On application of the compression force by tightening the bolts 46 on the conductors 7, the spring is deformed but is capable of maintaining its elastic resilience and sufficient springback to generate and maintain the required compression force on the conductor. The force generated by springback of the energy-storage device 45 is determined by the dimensions and materials properties of the spring. If necessary, the spring 45 may be coated with materials that enhance electrical conductance properties and resistance to dry corrosion and galvanic corrosion. In the embodiment illustrated in FIG. 14, the spring material must be of such strength that any permanent mechanical deformation sustained during crimping does not compromise its capability to store a large amount of energy in elastic deformation. In the embodiment illustrated in FIG. 14, the spring 45 may also be made from an elastomeric or other non-metallic but elastically-pliable material capable of imparting mechanical deformation to the conductors and connector body and remaining elastically deformed for the expected service life of the connector without losing springback properties.

Also, the springs need not consist of a single device but may involve of a number of springs in series in the crimp or compression connector. In all cases, the spring must be fabricated from a strong metal or a polymeric material, or a combination of these two or any other materials capable of sustaining mechanical deformation but without loss of capability of storing acceptable amounts of elastic energy. It is the intention of this invention to indicate that the introduction of an appropriate spring in a compression (crimp) connector, or in a bolted compression connector, in contact with the conductor, capable of imparting mechanical deformation to conductors and connector during compression, and capable of sustaining permanent mechanical deformation without compromising its own elastic resilience/springback properties, will enhance significantly the electrical reliability of the connector.

FIGS. 10-14 illustrate different embodiments of the use of an elastic-energy storage spring in a compression sleeve, according to the invention.

REFERENCES

1. R. Holm, Electric Contacts, Theory and Applications, Springer-Verlag, Berlin, 1976.
2. R. S. Mroczkowski, Electronic Connector Handbook, McGraw-Hill, New York, 1998.
3. Electric Contacts: Theory and Applications, Ed. P. G. Slade, Marcel Dekker, Inc., New York, 1999.
4. R. S. Timsit, "Electrical Contact Resistance: Fundamental Principles", in Electric Contacts: Theory and Applications, Ed. P. G. Slade, p. 1, Marcel Dekker, Inc., New York, 1999.
5. M. Braunovic, "Power Connections", p. 155, Electric Contacts: Theory and Applications, Ed. P. G. Slade, Marcel Dekker, Inc., New York, 1999.
6. F. W. Kussy and J. L. Warren, Design Fundamentals for Low-Voltage Distribution and Control, Marcel Dekker, Inc., New York, 1987.
7. J. H. Bickford, Introduction to the Design and Behavior of Bolted Joints, $4^{th}$ Edition, CRC Press, Boca Raton, Fla., 2008.
8. A. J. Bilotta, Connections in Electronic Assemblies. Marcel Dekker, Inc., New York, 1985.

9. A. Hunt III, L. A. Mayer and K. R. Denlinger, "Pin and Socket Electrical Connector with Alternate Seals", U.S. Pat. No. 5,078,622, Jan. 7, 1992.
10. W. F. Broske, C. Hill, H. W. Demler, W. H. Knowles Jr., and F. W. Wahl, "Method of Making an Electrical Connection to a Stranded Cable," U.S. Pat. No. 3,235,944, Feb. 22, 1966.
11. W. F. Broske, "Explosive Device to Force a Wedge into a Clamp for Clamping Cables," U.S. Pat. No. 3,212,534, Oct. 19, 1965.
12. B. W. Callen, B. Johnson, P. King, W. H. Abbott and R. S. Timsit, "Environmental Degradation of Utility Power Connectors in a Harsh Environment", IEEE Trans. CPT, vol. 23, p. 261, 2000.
13. G. W. Di Troia, J. R. Hickman and D. J. Stanton, "Connector Application and Performance Survey", Proc. Trans. Distr. Conf and Exposition: Latin America, p. 947, 2004.
14. R. S. Timsit, "Contact Properties of Tubular Crimp Connections: Elementary Considerations", Proc. 54$^{th}$ IEEE Holm Conf. Electrical Contacts, Orlando, Fla., p. 161, 2008.
15. T. Morita, K. Ohuchi, M. Kaji, Y. Saitoh, J. Shioya, K. Sawada, M. Takahashi, T. Kato and K. Murakami, "Numerical Model of Crimping by Finite Element Method", Proc. 41$^{st}$ IEEE Holm Conf. on Elect. Contacts, p. 151, 1996.
16. G. Villeneuve, D. Kulkarni, P. Bastnagel and D. Berry, "Dynamic Finite Element Analysis Simulation of the Terminal crimping Process", Proc. 41$^{st}$ IEEE Holm Conf. on Elect. Contacts, p. 156, 1996.
17. R. F. Tylecote, The Solid Phase Welding of Metals, Edward Arnold (Publishers), Ltd., London, UK, 1968.
18. M. Runde, R. S. Timsit and N. Magnusson, "Laboratory Performance Tests on Aluminum Splices for Power Conductors", Eur. Trans. Elect. Power, vol. 20, p. 450, 2010.
19. J. D. Hoffman and E. E. Holke, "Electrical Connectors," U.S. Pat. No. 2,707,775, May 3, 1955.
20. S. P. Becker and H. R. Wengen, "Strand Connector," U.S. Pat. No. 2,884,478, Apr. 28, 1959.
21. M. Brenner, "Connector," U.S. Pat. No. 2,956,108, Oct. 11, 1960.
22. A. R. Mallanik, A. C. Neaderland, W. G. Osborn and E. S. Raila, "Electrical Connector," U.S. Pat. No. 3,053,930, Sep. 11, 1962.
23. L. S. Lynch, E. L. Eldridge and J. A. Schiller, "Connector with Temporary Holding Means," U.S. Pat. No. 3,183,025, May 11, 1965.
24. J. A. Toedtman, "Compressible Electrical Connector," U.S. Pat. No. 3,236,938, Feb. 22, 1966.
25. E. L. Eldridge, "Compression Tap," U.S. Pat. No. 3,235,654, Feb. 15, 1966.
26. P. F. Levinsky, "Compressible Connector," U.S. Pat. No. 3,354,517, Nov. 28, 1967.
27. E. E. Holke, H. C. Westcott and J. A. Thornton, "Compression Connector with Removable Tabs for a Range of Conductor Sizes," U.S. Pat. No. 3,330,903, Jul. 11, 1967.
28. C. G. Zemels, "Compression Connector," U.S. Pat. No. 3,322,888, May 30, 1967.
29. D. Dannes, "Electrical Connector with Conductor Retainers," U.S. Pat. No. 3,408,455, Oct. 29, 1968.
30. J. J. Klosin, "Electrical Connector," U.S. Pat. No. 3,668,613, Jun. 6, 1972.
31. V. E. Peek, "Electrical Connector for Electrical Conductors," U.S. Pat. No. 3,781,459, Oct. 29, 1973.
32. C. H. Weidler, "Crimping Connector Means for Fine Wire," U.S. Pat. No. 3,897,992, Aug. 5, 1975.
33. L. Bock, "Electrical Connector," U.S. Pat. No. 4,940,856, Jul. 10, 1990.
34. G. Gordon, "Electrical Connector," U.S. Pat. No. 4,950,838, Aug. 21, 1990.
35. G. E. Schrader and U. F. Nager, "Full Closure H-Shaped Connector," U.S. Pat. No. 5,162,615, Nov. 10, 1992.
36. J. M. Piriz, W. O. Deck and F. A. O'Loughlin, "H-Tap Compression Connector," U.S. Pat. No. 5,396,033, Mar. 7, 1995.
37. J. M. Piriz, "Compression Connectors," U.S. Pat. No. 5,635,676, Jun. 3, 1997.
38. R. Chadbourne, D. D. Dobrinski, W. J. Lasko, and G. E. Schrader, "Twisted H-Shaped Electrical Connector," U.S. Pat. No. 5,898,131, Apr. 27, 1999.
39. B. W. Connor, "Electrical Compression Connector," U.S. Pat. No. 6,486,403 B1, Nov. 26, 2002.
40. B. W. Connor, G. W. Di Troia and H. T. Nelson, "Compression Connector," U.S. Pat. No. 6,525,270 B1, Feb. 25, 2003.
41. B. W. Connor, "Electrical Compression Connector," U.S. Pat. No. 6,538,204 B2, Mar. 25, 2003.
42. B. W. Connor and B. J. Michaud, "Electrical Compression Connector," U.S. Pat. No. 6,552,271 B2, Apr. 22, 2003.
43. B. W. Connor and B. J. Michaud, "Electrical Compression Connector," U.S. Pat. No. 6,747,211 B2, Jun. 8, 2004.

It is understood that the foregoing descriptions of elastic-energy storage devices, herein termed "springs" are only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising an internal, resiliently flexible spring insert within a compression or crimp connector, or in a bolted compression connector, which spring insert is in contact with electrical conductors so that said conductors are connected electrically to said compression, crimp or bolted compression connector, wherein said spring insert is inserted into said connector, and is permanently mechanically deformed during compression of said connector, and wherein said entire spring insert provides elastic resilience and elastic springback properties when permanently mechanically deformed so as to generate and maintain the required compression force on said electrical conductors and thereby maintain said conductors in electrical contact with said compression, crimp or bolted compression connector, by forcing at least some of said electrical conductors to be in direct contact with said compression, crimp or bolted compression connector.

2. An electrical connector as claimed in claim 1 comprising an internal mechanical spring insert within said compression or crimp connector, or in a bolted compression connector, in contact with the electrical conductors to be connected electrically wherein said spring insert is made of metal.

3. An electrical connector comprising a metal mechanical spring as defined in claim 2 wherein the force generated by springback of the spring insert is determined by the dimensions and materials properties of the spring insert.

4. An electrical connector comprising a metal mechanical spring insert as defined in claim 2 wherein the spring insert dimensions are determined by the dimensions of the compression or crimp connector.

5. An electrical connector comprising a metal mechanical spring insert as in claim 2 wherein the material of which the spring insert is constructed must be of such strength that the permanent mechanical deformation sustained during crimping does not compromise its capability to store an acceptable amount of energy in elastic deformation and wherein the surface of the spring insert may be modified to enhance electrical conductivity properties and resistance to oxidation and galvanic corrosion.

6. An electrical connector comprising a plurality of metal mechanical spring inserts as defined in claim 2 in contact with the electrical conductors to be connected electrically wherein the spring inserts act co-jointly and are permanently mechanically deformed during compression of the connector and wherein the spring inserts provide elastic resilience and elastic springback properties when permanently mechanically deformed so as to generate and maintain the required compression force on the conductor.

7. An electrical connector comprising a plurality of metal mechanical spring inserts as defined in claim 6 wherein the force generated by springback of the spring inserts is determined by the dimensions and materials properties of the spring inserts.

8. An electrical connector as claimed in claim 6 wherein said plurality of metal mechanical spring inserts have dimensions determined by the dimensions of the compression or crimp connector.

9. An electrical connector as claimed in claim 6 wherein said metal mechanical spring inserts are of a material of which the spring inserts are constructed to be of such strength that the permanent mechanical deformation sustained during crimping does not compromise their capability to store an acceptable amount of energy in elastic deformation and wherein the surface of the spring inserts may be modified to enhance electrical conductivity properties and resistance to oxidation and galvanic corrosion.

10. An electrical connector as claimed in claim 1 comprising an internal mechanical spring insert within said compression or crimp connector, in contact with the electrical conductors to be connected electrically, wherein said spring insert comprises a resiliently flexible polymeric material.

11. An electrical connector comprising a polymeric mechanical spring insert as claimed in claim 10 wherein the force generated by springback of the spring insert is determined by the dimensions and materials properties of the spring insert.

12. An electrical connector comprising a polymeric mechanical spring insert as claimed in claim 10 wherein the spring insert dimensions are determined by the dimensions of the compression or crimp connector.

13. An electrical connector comprising a polymeric mechanical spring insert as claimed in claim 10 wherein the material of which the spring insert is constructed must be of such strength that the permanent mechanical deformation sustained during crimping does not compromise its capability to store an acceptable amount of energy in elastic deformation.

14. A spring insert for use in an electrical connector as claimed in claim 1.

15. A spring insert for use in an electrical connector as claimed in claim 2.

16. A spring insert for use in an electrical connector as claimed in claim 10.

* * * * *